US007806198B2

(12) United States Patent
Puzio

(10) Patent No.: US 7,806,198 B2
(45) Date of Patent: Oct. 5, 2010

(54) HYBRID IMPACT TOOL

(75) Inventor: Daniel Puzio, Baltimore, MD (US)

(73) Assignee: Black & Decker Inc., Newark, DE (US)

( * ) Notice: Subject to any disclaimer, the term of this patent is extended or adjusted under 35 U.S.C. 154(b) by 174 days.

(21) Appl. No.: 12/138,516

(22) Filed: Jun. 13, 2008

(65) Prior Publication Data

US 2008/0308286 A1 Dec. 18, 2008

Related U.S. Application Data

(60) Provisional application No. 60/944,225, filed on Jun. 15, 2007.

(51) Int. Cl.
*E02D 7/06* (2006.01)

(52) U.S. Cl. ..... 173/1; 173/46; 173/48; 173/203; 173/70

(58) Field of Classification Search ..... 173/1, 173/46, 47, 48, 93.5, 93.6, 93.7, 202, 203, 173/205, 145, 146, 170, 216
See application file for complete search history.

(56) References Cited

U.S. PATENT DOCUMENTS

| | | | | |
|---|---|---|---|---|
| 3,195,702 | A | | 7/1965 | Alexander |
| 3,207,237 | A | | 9/1965 | Wanner |
| 3,584,695 | A | | 6/1971 | Turnbull et al. |
| 3,648,784 | A | | 3/1972 | Schoeps et al. |
| 3,710,873 | A | | 1/1973 | Allen et al. |
| 3,741,313 | A | | 6/1973 | States et al. |
| 4,428,438 | A | | 1/1984 | Holzer et al. |
| 4,986,369 | A | | 1/1991 | Fushiya et al. |
| 5,025,903 | A | | 6/1991 | Elligson |
| 5,080,180 | A | | 1/1992 | Hansson et al. |
| 5,447,205 | A | | 9/1995 | Thurler |
| 5,457,860 | A | | 10/1995 | Miranda |
| 5,458,206 | A | * | 10/1995 | Bourner et al. ..... 173/178 |
| 5,474,139 | A | | 12/1995 | Odendahl et al. |
| 5,673,758 | A | | 10/1997 | Sasaki et al. |
| 5,706,902 | A | | 1/1998 | Eisenhardt et al. |
| 5,711,380 | A | * | 1/1998 | Chen ..... 173/48 |
| 5,836,403 | A | | 11/1998 | Putney et al. |
| 5,842,527 | A | * | 12/1998 | Arakawa et al. ..... 173/48 |
| 5,868,208 | A | | 2/1999 | Peisert et al. |

(Continued)

FOREIGN PATENT DOCUMENTS

| | | |
|---|---|---|
| DE | 1949415 | 10/1970 |

(Continued)

*Primary Examiner*—Paul R Durand
(74) *Attorney, Agent, or Firm*—Harness, Dickey & Pierce, P.L.C.

(57) ABSTRACT

A power tool with a motor, a transmission and a rotary impact mechanism. The transmission receives rotary power from the motor and includes a transmission output member. The rotary impact mechanism has a first spindle, a second spindle, a hammer and an anvil. The second spindle is disposed coaxially with the first spindle and the hammer is drivingly coupled to the second spindle. The power tool also includes a device that selectively couples the first and second spindles with the anvil and the transmission output member. Coupling of the first spindle with the anvil and the transmission output member directly drives the anvil, whereas coupling of the second spindle with the anvil and the transmission output member drives the anvil through the hammer.

20 Claims, 5 Drawing Sheets

U.S. PATENT DOCUMENTS

| | | | | |
|---|---|---|---|---|
| 6,135,212 | A | 10/2000 | Georgiou et al. | |
| 6,142,242 | A | 11/2000 | Okumura et al. | |
| 6,176,321 | B1 | 1/2001 | Arakawa et al. | |
| 6,196,330 | B1 | 3/2001 | Matthias et al. | |
| 6,223,833 | B1 | 5/2001 | Thurler et al. | |
| 6,457,535 | B1 | 10/2002 | Tanaka et al. | |
| 6,457,635 | B1 | 10/2002 | Scicluna | |
| 6,535,212 | B1 | 3/2003 | Goto et al. | |
| 6,535,636 | B1 | 3/2003 | Savakis et al. | |
| 6,691,796 | B1 * | 2/2004 | Wu | 173/48 |
| 6,805,207 | B2 | 10/2004 | Hagan et al. | |
| 6,834,730 | B2 | 12/2004 | Gass et al. | |
| 6,887,176 | B2 | 5/2005 | Sasaki et al. | |
| 6,892,827 | B2 | 5/2005 | Toyama et al. | |
| 6,976,545 | B2 | 12/2005 | Greitmann et al. | |
| 7,032,683 | B2 * | 4/2006 | Hetcher et al. | 173/1 |
| 7,048,075 | B2 | 5/2006 | Saito et al. | |
| 7,073,605 | B2 | 7/2006 | Saito et al. | |
| 7,086,483 | B2 | 8/2006 | Arimura et al. | |
| 7,093,668 | B2 | 8/2006 | Gass et al. | |
| 7,101,300 | B2 | 9/2006 | Milbourne et al. | |
| 7,121,358 | B2 | 10/2006 | Gass et al. | |
| 7,124,839 | B2 | 10/2006 | Furuta et al. | |
| 7,131,503 | B2 | 11/2006 | Furuta et al. | |
| 7,201,235 | B2 | 4/2007 | Umemura et al. | |
| 7,207,393 | B2 | 4/2007 | Clark, Jr. et al. | |
| 7,213,659 | B2 | 5/2007 | Saito et al. | |
| 7,216,749 | B2 | 5/2007 | Droste et al. | |
| 7,223,195 | B2 | 5/2007 | Milbourne et al. | |
| 7,225,884 | B2 | 6/2007 | Aeberhard et al. | |
| 7,306,049 | B2 | 12/2007 | Soika et al. | |
| 7,308,948 | B2 | 12/2007 | Furuta et al. | |
| 7,314,097 | B2 | 1/2008 | Jenner et al. | |
| 7,322,427 | B2 | 1/2008 | Shimma et al. | |
| 7,328,752 | B2 | 2/2008 | Gass et al. | |
| 7,331,408 | B2 | 2/2008 | Arich et al. | |
| 7,331,496 | B2 | 2/2008 | Britz et al. | |
| 2003/0146007 | A1 | 8/2003 | Greitmann | |
| 2004/0134673 | A1 * | 7/2004 | Droste | 173/178 |
| 2004/0245005 | A1 | 12/2004 | Toyama et al. | |
| 2005/0028997 | A1 | 2/2005 | Hagan et al. | |
| 2005/0061521 | A1 | 3/2005 | Saito et al. | |
| 2005/0263303 | A1 | 12/2005 | Shimizu et al. | |
| 2005/0263304 | A1 | 12/2005 | Sainomoto et al. | |
| 2005/0263305 | A1 | 12/2005 | Shimizu et al. | |
| 2006/0006614 | A1 | 1/2006 | Buchholz et al. | |
| 2006/0021771 | A1 | 2/2006 | Milbourne et al. | |
| 2006/0086514 | A1 | 4/2006 | Aeberhard | |
| 2006/0090913 | A1 | 5/2006 | Furuta | |
| 2006/0213675 | A1 | 9/2006 | Whitmire et al. | |
| 2006/0237205 | A1 | 10/2006 | Sia et al. | |
| 2006/0254786 | A1 | 11/2006 | Murakami et al. | |
| 2006/0254789 | A1 | 11/2006 | Murakami et al. | |
| 2006/0266537 | A1 | 11/2006 | Izumisawa | |
| 2007/0056756 | A1 * | 3/2007 | Chung et al. | 173/48 |
| 2007/0068692 | A1 | 3/2007 | Puzio | |
| 2007/0068693 | A1 | 3/2007 | Whitmire et al. | |
| 2007/0074883 | A1 | 4/2007 | Strasser et al. | |
| 2007/0084614 | A1 | 4/2007 | Whitmire et al. | |
| 2007/0174645 | A1 | 7/2007 | Lin | |
| 2007/0181319 | A1 * | 8/2007 | Whitmine et al. | 173/48 |
| 2007/0201748 | A1 | 8/2007 | Bixler et al. | |
| 2008/0035360 | A1 | 2/2008 | Furuta | |
| 2008/0041602 | A1 | 2/2008 | Furuta | |

FOREIGN PATENT DOCUMENTS

| | | |
|---|---|---|
| DE | 1652685 | 12/1970 |
| DE | 1941093 | 4/1971 |
| DE | 2557118 | 6/1977 |
| DE | 4038502 | 6/1992 |
| DE | 4328599 | 3/1994 |
| DE | 9404069 | 6/1994 |
| DE | 9406626 | 6/1994 |
| DE | 19954931 | 6/2001 |
| DE | 20209356 | 10/2002 |
| DE | 20305853 | 9/2003 |
| DE | 20304314 | 7/2004 |
| DE | 102004037072 | 1/2006 |
| EP | 0404035 | 12/1990 |
| EP | 0808695 | 11/1997 |
| EP | 1621290 | 2/2006 |
| EP | 1707322 | 10/2006 |
| GB | 1574652 | 9/1980 |
| GB | 2102718 | 2/1983 |
| GB | 2274416 | 7/1994 |
| GB | 2328635 | 3/1999 |
| GB | 2334909 | 9/1999 |
| GB | 2404891 | 2/2005 |
| JP | 62173180 | 7/1987 |
| JP | 62297007 | 12/1987 |
| JP | 63123678 | 5/1988 |
| JP | 2139182 | 5/1990 |
| JP | 2284881 | 11/1990 |
| JP | 3043164 | 2/1991 |
| JP | 3168363 | 7/1991 |
| JP | 6010844 | 1/1994 |
| JP | 6023923 | 2/1994 |
| JP | 6182674 | 7/1994 |
| JP | 6210507 | 8/1994 |
| JP | 6215085 | 8/1994 |
| JP | 07040258 | 2/1995 |
| JP | 7080711 | 3/1995 |
| JP | 7328955 | 12/1995 |
| JP | 9136273 | 5/1997 |
| JP | 9239675 | 9/1997 |
| JP | 10291173 | 11/1998 |
| JP | 2000233306 | 8/2000 |
| JP | 2000246659 | 9/2000 |
| JP | 2001009746 | 1/2001 |
| JP | 2001088051 | 4/2001 |
| JP | 2001088052 | 4/2001 |
| JP | 2001105214 | 4/2001 |
| JP | 2002059375 | 2/2002 |
| JP | 2002178206 | 6/2002 |
| JP | 2002224971 | 8/2002 |
| JP | 2002273666 | 9/2002 |
| JP | 2003071745 | 3/2003 |
| JP | 2003220569 | 8/2003 |
| JP | 2004130474 | 4/2004 |
| JP | 2005052904 | 3/2005 |
| JP | 3655481 | 6/2005 |
| JP | 2006123081 | 5/2006 |
| JP | 2006175562 | 7/2006 |
| WO | WO-9521039 | 8/1995 |
| WO | WO-2007135107 | 11/2007 |

* cited by examiner

HYBRID IMPACT TOOL

CROSS-REFERENCE TO RELATED APPLICATIONS

This application claims the benefit of U.S. Provisional Patent Application Ser. No. 60/944,225 entitled "Hybrid Impact Tool" filed Jun. 15, 2007, the disclosure of which is incorporated by reference as if fully set forth in its entirety herein.

INTRODUCTION

The present invention generally relates to rotary impact tools and more particularly to a rotary impact tool that can be operated in a mode that transmits rotary power around its impact mechanism to directly drive an output spindle.

Rotary impact tools are known to be capable of producing relatively high output torque and as such, can be suited in some instances for driving screws and other threaded fasteners. One drawback associated with conventional rotary impact tools concerns their relatively slow fastening speed when a threaded fastener is subject to a prevailing torque (i.e., a not insubstantial amount of torque is required to drive the fastener into a workpiece before the head of the fastener is abutted against the workpiece). Examples of such applications include driving large screws, such as lag screws, into a wood workpiece. In such applications, it is not uncommon for a rotary impact tool to begin impacting shortly after the tip of the lag screw is driven into the workpiece. As lag screws can be relatively long, a significant amount of time can be expended in driving lag screws into workpieces.

Hybrid impact tools permit a user to selectively lock-out the impact mechanism of a rotary impact tool. Such hybrid impact tools can be employed in a rotary impact mode and a non-impacting mode in which the output spindle is directly driven. One problem that we have identified with these tools concerns the installation of relatively large threaded fasteners into a workpiece where the fastener is subject to a prevailing torque. In such situations, we have found that it may be desirable to initially seat the threaded fastener while operating the tool in a non-impacting mode and thereafter employ a rotary impacting mode to fully tighten the threaded fastener. Where the hybrid impact tool relies on the user to manually select the mode of operation prior to initiation of the fastening cycle, the user is required to initially set the tool into a first mode, partially install the threaded fastener, stop the tool and adjust the tool to a second mode, and thereafter complete the installation of the fastener. Accordingly, we have endeavored to provide a hybrid impact tool that is robust, reliable and which can be switched from one mode of operation to another mode of operation without first halting a fastening cycle.

SUMMARY

In one form, the present teachings provide a power tool with a motor, a transmission and a rotary impact mechanism. The transmission receives rotary power from the motor and includes a transmission output member. The rotary impact mechanism has a first spindle, a second spindle, a hammer and an anvil. The second spindle is disposed coaxially with the first spindle and the hammer is drivingly coupled to the second spindle. The power tool also includes a means for selectively coupling the first and second spindles with the anvil and the transmission output member. Coupling of the first spindle with the anvil and the transmission output member directly drives the anvil, whereas coupling of the second spindle with the anvil and the transmission output member drives the anvil through the hammer.

In another form, the present teachings provide a method that includes: providing a power tool with a transmission, an impact mechanism and an output spindle, the impact mechanism having a hammer and an anvil and being disposed between the transmission and the output spindle; operating the power tool in a torsional impact mode in which rotary power is transmitted from the transmission to the hammer and the hammer cyclically disengages and re-engages the anvil; and pushing the output spindle toward the transmission while operating the power tool to engage a clutch, wherein engagement of the clutch causes rotary power to be transmitted from the transmission to the anvil such that the anvil is driven regardless of whether or not the hammer is engaged to the anvil.

Further areas of applicability will become apparent from the description provided herein. It should be understood that the description and specific examples are intended for purposes of illustration only and are not intended to limit the scope of the present disclosure, its application and/or uses in any way.

BRIEF DESCRIPTION OF THE DRAWINGS

The drawings described herein are for illustration purposes only and are not intended to limit the scope of the present disclosure in any way. Similar or identical elements are given consistent identifying numerals throughout the various figures.

DETAILED DESCRIPTION OF THE VARIOUS EMBODIMENTS

Figure 1:
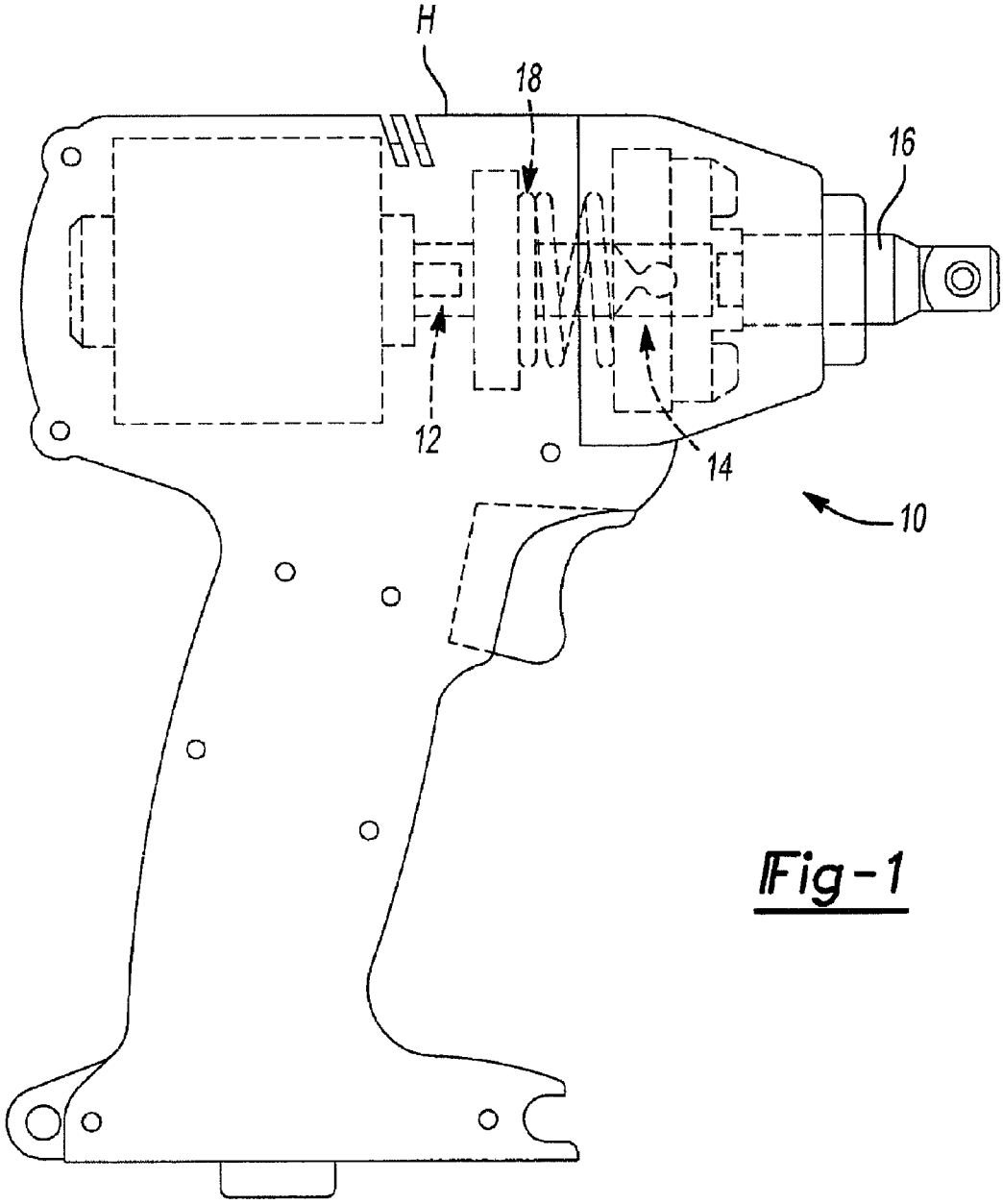
FIG. 1 is a side elevation view of an exemplary hybrid impact tool constructed in accordance with the teachings of the present disclosure.
Figure 2:
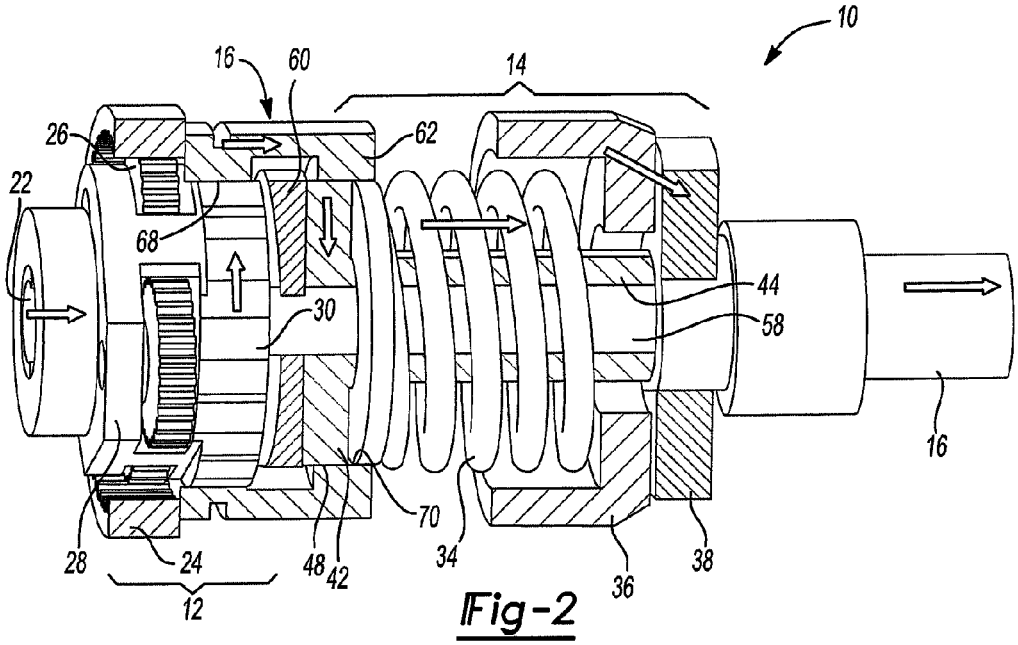
FIG. 2 is a partially sectioned perspective view of a portion of the hybrid impact tool of FIG. 1, illustrating the hybrid impact tool in a rotary impact mode.

With reference to FIGS. 1 and 2 of the drawings, a hybrid impact tool constructed in accordance with the teachings of the present invention is generally indicated by reference numeral 10. The hybrid impact tool 10 can include a transmission 12, an impact mechanism 14, an output spindle 16 and a mode change mechanism 18.

Figure 3:
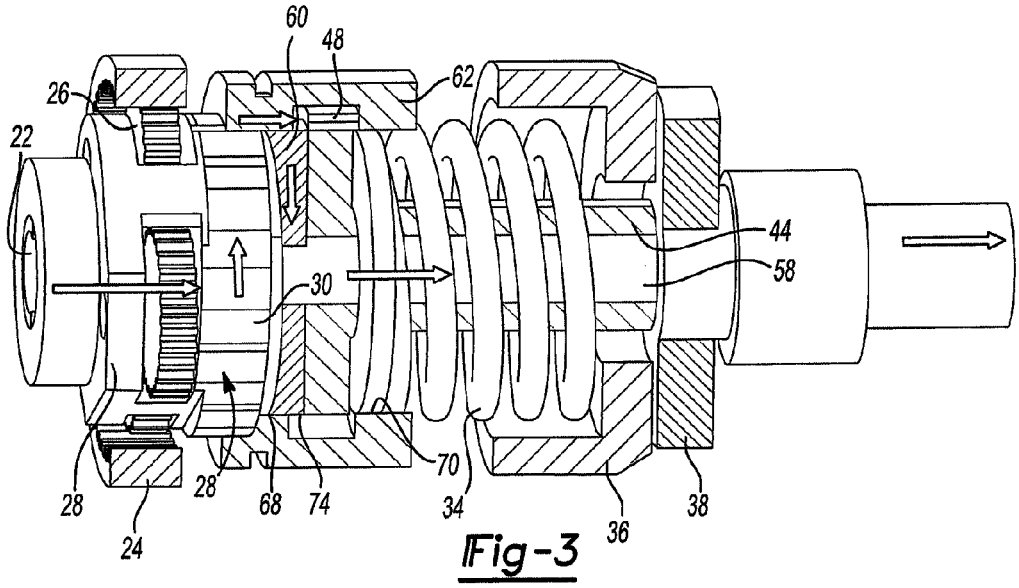
FIG. 3 is a partially sectioned perspective view similar to that of FIG. 2 but illustrating the hybrid impact tool in a direct-drive mode.
Figure 4:
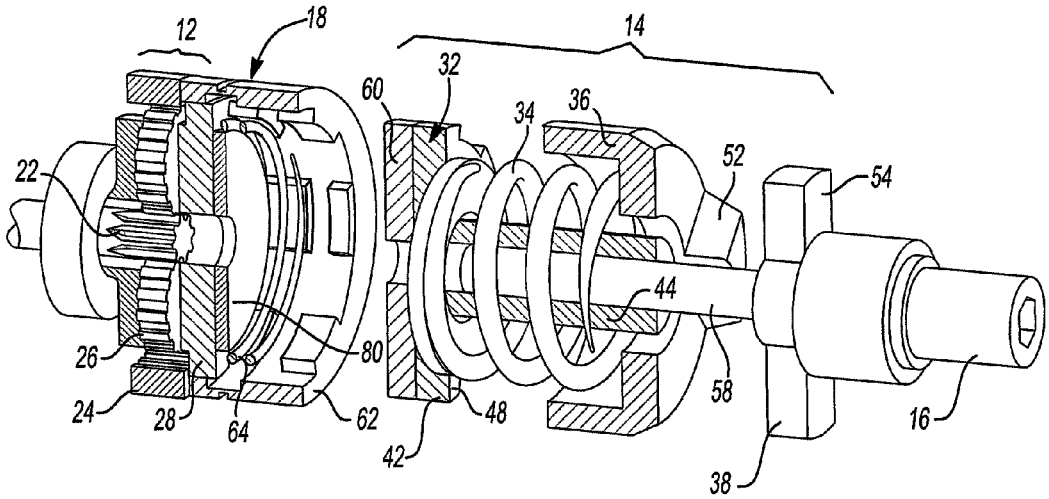
FIG. 4 is a partially sectioned exploded perspective view of a portion of the hybrid impact tool of FIG. 1.

With reference to FIGS. 2 through 4, the transmission 12 is a conventional planetary transmission having an input sun gear 22, a ring gear 24, a set of planet gears 26 and a planet carrier 28. It will be appreciated that the planet carrier 28 is a transmission output member. The sun gear 22 is driven by a motor (not shown). The ring gear 24 is maintained in a stationary (non-rotating) condition, for example by non-rotatably coupling the ring gear to a housing H (FIG. 1). The planet gears 26 meshingly engage the sun gear 22 and the ring gear 24. The planet carrier 28 includes pins on which the planet gears 26 are rotatably disposed. A first toothed exterior perimeter 30 (FIG. 3) is formed on the planet carrier 28. Rotation of the sun gear 22 will cause corresponding rotation of the planet carrier 28, albeit at a reduced speed and increased torque.

The impact mechanism 14 includes a first drive member 32, a spring 34, a hammer 36 and an anvil 38. The first drive member 32 includes a plate member 42 and a spindle or tubular member 44 that extends along the longitudinal axis of the transmission 12. A second toothed exterior perimeter 48 is formed on the plate member 42. The spring 34 is disposed about the tubular member 44 between the plate member 42 and the hammer 36. The hammer 36 is coupled with the tubular member 44 in a conventional manner (not specifically shown) that permits the hammer 36 to be rotationally driven by the tubular member 44 but slide axially on the tubular member 44. The hammer 36 includes a set of hammer teeth 52. The anvil 38 is coupled to the output spindle 16 and includes a set of anvil teeth 54 and a spindle or stem 58 that extends through the tubular member 44. The set of anvil teeth 54 can be meshingly engaged to the hammer teeth 52.

The mode change mechanism 18 includes a second drive member 60, a coupling ring 62 and a mode spring 64. The second drive member 60 is coupled for rotation with the stem 58 of the anvil 38. The coupling ring 62 is axially translatable along the longitudinal axis of the transmission 12 and includes a first toothed interior perimeter 68 (FIG. 3), which is meshingly engaged to the first toothed exterior perimeter 30 (FIG. 3) on the planet carrier 28 and a second toothed interior perimeter 70 (FIG. 3) that can be engaged to the second toothed exterior perimeter 48. As those of skill in the art will appreciate, various types of known switching mechanisms can be employed to axially translate the coupling ring 62. For example, the rotary sliding actuator disclosed in U.S. Pat. No. 6,431,289 could be employed to translate the coupling ring 62. It will be appreciated that such switching mechanisms can be employed to maintain the coupling ring 62 in at desired location such that movement of the coupling ring 62 requires that the switching mechanism be manipulated by the user (e.g., translated or rotated) to re-position the coupling ring 62. It will also be appreciated that such switching mechanisms can also be configured with a degree of compliance that maintains the coupling ring in a given position but which permits the user to resiliently "override" the switching mechanism, for example by pushing axially onto the tool to drive the output spindle 16 toward the transmission 12. Accordingly, it will be appreciated that such switching mechanism can be capable of being switched into modes that provide two or more of the following operational modes: drilling (i.e., an operational mode that is primarily configured to output rotary, non-impacting power to the output spindle 16), rotary impacting (i.e., an operational mode that is primarily configured to output rotary impacting power to the output spindle 16) and a combination mode (i.e., an operational mode that can be user- or automatically-controlled to switch between the drilling and rotary impacting modes during a cycle).

Movement of the coupling ring 62 to a rearward position (closest to the transmission 12) aligns the second drive member 60 to an annular space 74 (FIG. 3) between the first and second toothed interior perimeters 68 and 70 (FIG. 3), which permits relative rotation between the coupling ring 62 and the second drive member 60, and a forward position in which the first toothed interior perimeter 68 (FIG. 3) is also engaged to the second drive member 60 (to thereby rotatably couple the coupling ring 62 to the second drive member 60).

When the coupling ring 62 is disposed in its rearward position as shown in FIG. 2, rotation of the planet carrier 28 will cause corresponding rotation of the coupling ring 62 and therefore the hammer 36 (through the first drive member 32) to permit the hybrid impact tool 10 to operate in a rotary impact mode. When the coupling ring 62 is disposed in its forward position as shown in FIG. 3, rotation of the planet carrier 28 will cause corresponding rotation of the coupling ring 62, which will drive the second drive member 60. Since the second drive member 60 is coupled for rotation with the anvil 38 (and therefore to the output spindle 16), the output spindle 16 will be directly driven and the impact mechanism 14 will not impact. In this regard, all power from the transmission 12 (FIG. 2) is transmitted through the anvil 38 and the output spindle 16 when the coupling ring 62 is engaged to the second drive member 60.

The hybrid impact tool 10 can be further operated in a third mode in which the output spindle 16 is initially direct-driven and thereafter driven by the impact mechanism 14. In this mode, the coupling ring 62 is disposed in its rearward position (which will normally permit the assembly to be operated in a rotary impact mode). The user, however, will apply an axial force to the output spindle 16 to push the stem 58 and the second drive member 60 rearward so that the second drive member 60 can be coupled for rotation with the planet carrier 28. For example, the second drive member 60 could be moved rearwardly against the bias of the mode spring 64 to engage the first toothed interior perimeter 68. As another example, the second drive member 60 could be moved rearwardly against the bias of the mode spring 64 and frictionally engage a clutch surface 80 that is formed on the front face of the planet carrier 28. In operation, the user would apply an axial force to the tool to move the output spindle 16 rearwardly to direct-drive the output spindle 16. The user may reduce the axial force on the tool during the driving/fastening cycle to cause the mode spring 64 to move the second drive member 60 forwardly so as to permit the impact mechanism 14 to operate in a rotary impact mode.

Those of skill in the art will appreciate that the trip torque at which the impact mechanism 14 will begin to operate (i.e., the torque at which the hammer 36 will separate from the anvil 38 and thereafter impact against the anvil 38) can be set relatively low but that an operator could effectively raise the trip torque of the impact mechanism 14 as required when the hybrid impact tool 10 is operated in the third mode. Configuration in this manner can provide the operator with better control at relatively low torques, while permitting the operator to effectively adjust the trip torque of the impact mechanism 14 "on the fly" to achieve higher productivity when operating the hybrid impact tool 10 to drive fasteners at relatively high torques.

Figure 5:
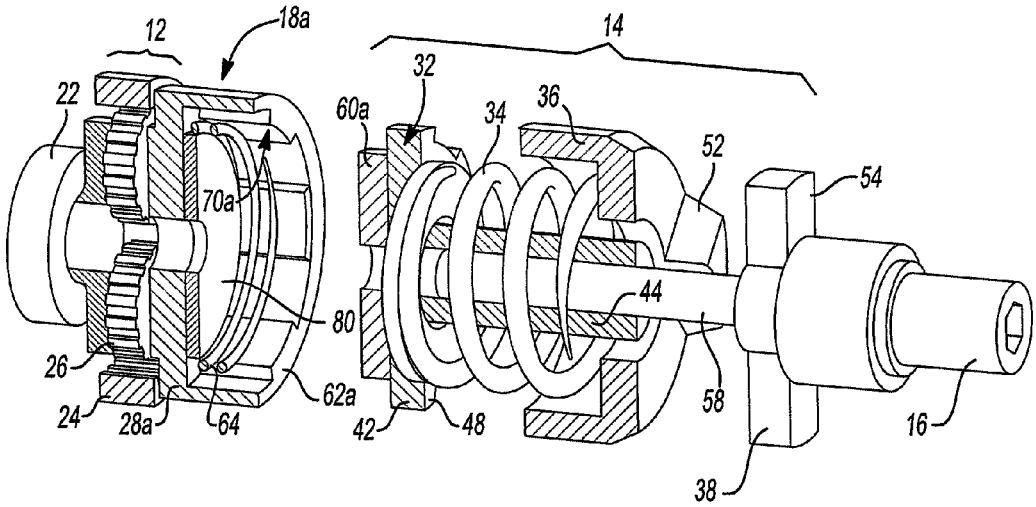
FIG. 5 is a partially sectioned exploded perspective view of a portion of another hybrid impact tool constructed in accordance with the teachings of the present disclosure.

With reference to FIG. 5, a portion of another hybrid impact tool 10*a* that is constructed in accordance with the teachings of the present invention is illustrated. The hybrid impact tool 10*a* can be generally similar to the hybrid impact tool 10 described above and illustrated in FIGS. 1-4 and as such, the discussion below will focus on elements that are different from the corresponding elements described in conjunction with the hybrid impact tool 10, above.

In the particular embodiment illustrated, the coupling ring 62*a* can be fixedly coupled to (e.g., unitarily formed with) the planet carrier 28*a*. Unlike the coupling ring 62 described above, the coupling ring 62*a* includes a single toothed perimeter 70*a* that is meshingly engaged to the second toothed exterior perimeter 48 on the plate member 42 of the first drive member 32. The second drive member 60*a* is sized such that it does not meshingly engage the single toothed perimeter 70*a*. Rather, the second drive member 60*a* can be urged rearwardly by the user (via an axially rearward force applied to the output spindle 16) to cause the second drive member 60*a* to engage the clutch surface 80 on the planet carrier 28*a*. Accordingly, it will be appreciated that the hybrid impact tool 10*a* can normally operate in a rotary impact mode but could also be operated in a drill mode if the user were to apply an axial force to the output spindle 16 to drive the second drive member 60*a* into engagement with the clutch surface 80 on the planet carrier 28*a*.

Figure 6:
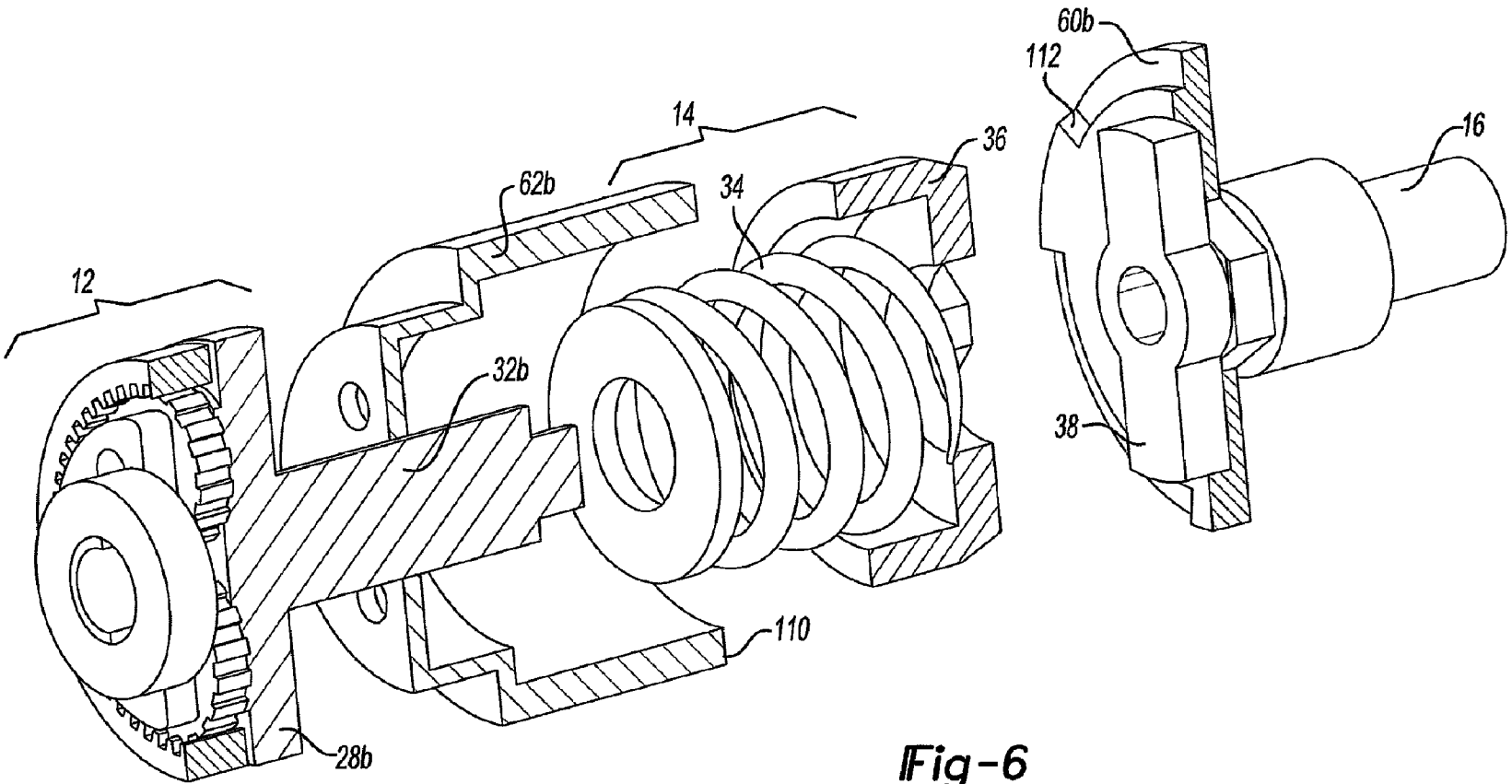
FIG. 6 is a partially sectioned exploded perspective view of a portion of yet another hybrid impact tool constructed in accordance with the teachings of the present disclosure.
Figure 7:
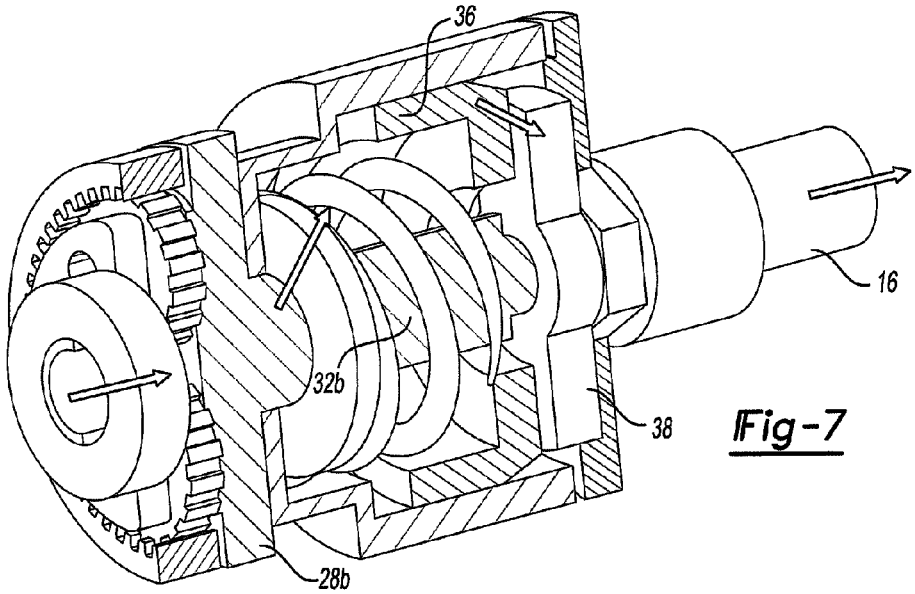
FIG. 7 is a partially sectioned perspective view of the hybrid impact tool of FIG. 6, illustrating the hybrid impact tool in a rotary impact mode.
Figure 8:
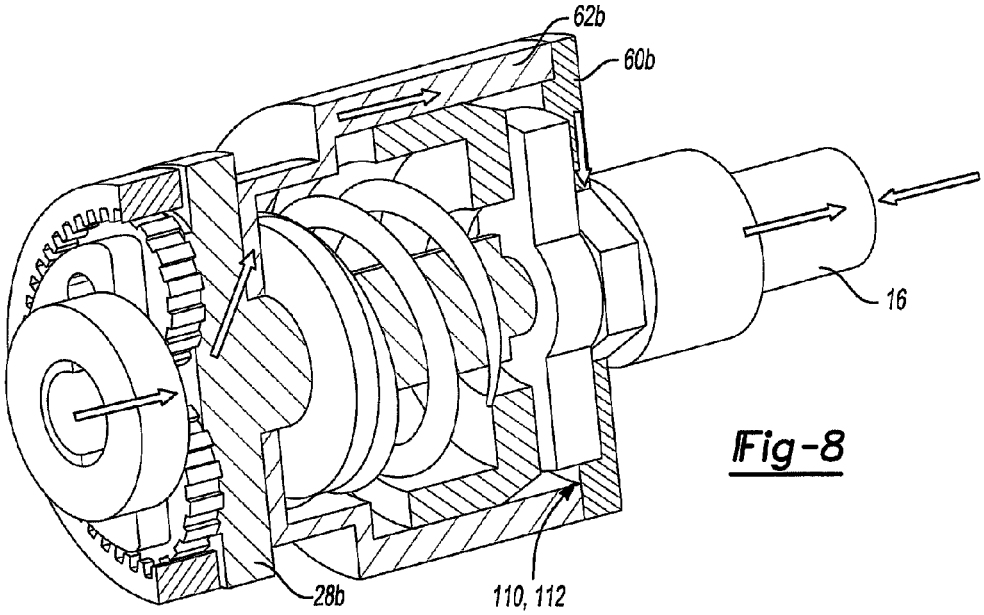
FIG. 8 is a partially sectioned perspective view similar to that of FIG. 7 but illustrating the hybrid impact tool in a direct-drive mode.

With reference to FIGS. 6-8, a portion of yet another hybrid impact tool 10*b* that is constructed in accordance with the teachings of the present invention is illustrated. The hybrid impact tool 10*b* can also be generally similar to the hybrid impact tool 10 described above and illustrated in FIGS. 1-4 and as such, the discussion below will focus on elements that are different from the corresponding elements described in conjunction with the hybrid impact tool 10, above.

In the particular embodiment illustrated, the first drive member 32*b* and the coupling ring 62*b* are coupled for rotation with the planet carrier 28*b*. The first drive member 32*b* is engaged to the hammer 36 in a manner that permits the hammer 36 to be rotationally driven by but axially slide upon the first drive member 32*b*. The coupling ring 62*b* extends about and forwardly of both the hammer 36 and the anvil 38. The coupling ring 62*b* includes a plurality of clutch teeth 110 that are disposed on its forward edge. The anvil 38 and the second drive member 60*b* are rotatably coupled to the output spindle 16. The second drive member 60*b* includes a plurality of mating clutch teeth 112 that can be engaged to the clutch teeth 110 of the coupling ring 62*b*. It will be appreciated that while not shown, a spring biases the output spindle 16 outwardly away from the transmission 12.

With specific reference to FIG. 7, the hybrid impact tool 10*b* can normally operate in a rotary impact mode wherein rotary power is output from the planet carrier 28*b*, through the first drive member 32*b*, the hammer 36, the anvil 38 and to the output spindle 16. With specific reference to FIG. 8, the output spindle 16 can be pushed rearwardly by the user to cause the clutch teeth 112 on the second drive member 60*b* to meshingly engage the clutch teeth 110 on the coupling ring 62*b*. In this condition, rotary power is output from the planet carrier 28*b* through the coupling ring 62*b* and the second drive member 60*b* to the output spindle 16.

As an alternative, the second drive member 60*b* can also be coupled for rotatation with but axially slidably engaged to the output spindel 16. In this alternatively configured power tool, the second drive member 60*b* can be axially positioned in fore and aft positions to selectively engage the coupling ring 62*b*.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims.

What is claimed is:

1. A method comprising:

providing a power tool with a transmission, a rotary impact mechanism and an output spindle, the rotary impact mechanism having a hammer and an anvil and being disposed between the transmission and the output spindle;

operating the power tool in a torsional impact mode in which rotary power is transmitted from the transmission to the hammer and the hammer cyclically disengages and re-engages the anvil; and pushing the output spindle toward the transmission while operating the power tool to engage a clutch, wherein engagement of the clutch causes rotary power to be transmitted from the transmission to the anvil such that the anvil is driven regardless of whether or not the hammer is engaged to the anvil.

2. The method of claim 1, wherein the rotary impact mechanism includes first and second spindles that are arranged coaxially with one another.

3. The method of claim 2, wherein the hammer is received into the first spindle.

4. A power tool comprising:

a motor;

a transmission receiving rotary power from the motor, the transmission having a transmission output member;

a rotary impact mechanism having a first spindle, a second spindle, a hammer and an anvil, the second spindle being disposed coaxially with the first spindle, the hammer being drivingly coupled to the second spindle; and means for selectively coupling the first and second spindles with the anvil and the transmission output member, wherein coupling of the first spindle with the anvil and the transmission output member directly drives the anvil and wherein coupling of the second spindle with the anvil and the transmission output member drives the anvil through the hammer.

5. The power tool of claim 4, wherein the anvil is coupled for rotation with the first spindle.

6. The power tool of claim 5, wherein the coupling means includes a mode collar that is selectively coupled to at least one of the first and second spindles.

7. The power tool of claim 6, wherein the mode collar is axially movable between a first position, in which the mode collar couples the first spindle to the transmission output member, and a second position in which the mode collar couples the second spindle to the transmission output member.

8. The power tool of claim 7, wherein the mode collar has a first set of teeth and a second set of teeth that are axially spaced apart from the first set of teeth, and wherein the first set of teeth are selectively engagable with the first spindle and the second set of teeth are selectively engagable with the second spindle.

9. The power tool of claim 8, wherein the first set of teeth are engaged to teeth formed on the transmission output member.

10. The power tool of claim 9, wherein a clutch is disposed between the transmission output member and the first spindle, wherein the first spindle is biased away from the transmission output member but is axially movable into an override position in which the first spindle is coupled to the transmission output member through the clutch when the mode collar is in the second position.

11. The power tool of claim 10, wherein the clutch is a friction clutch.

12. The power tool of claim 6, wherein the mode collar is integrally formed with the transmission output member.

13. The power tool of claim 12, wherein the mode collar includes a set of teeth that are meshingly engaged to a mating set of teeth formed on the second spindle.

14. The power tool of claim 13, wherein a clutch is disposed between the transmission output member and the first spindle, wherein the first spindle is biased away from the transmission output member but is axially movable into an override position in which the first spindle is coupled to the transmission output member through the clutch.

15. The power tool of claim 4, wherein the second spindle is disposed about the first spindle.

16. The power tool of claim 4, wherein the first spindle is coupled for rotation with at least one of the transmission output member and the second spindle.

17. The power tool of claim 16, wherein a clutch member is coupled for rotation with the anvil and wherein at least one of the first spindle and the clutch member is axially movable to permit the clutch member and the first spindle to be selectively engaged to one another.

18. The power tool of claim 17, wherein an end of the first spindle opposite the transmission output member includes a set of clutch teeth that are configured to engage a set of mating clutch teeth on the clutch member.

19. The power tool of claim 16, wherein the hammer is received into the first spindle.

20. A power tool comprising:

a motor;

a transmission receiving rotary power from the motor, the transmission having a transmission output member;

a rotary impact mechanism having a first spindle, a second spindle, a hammer and an anvil, the first spindle being coupled for rotation with the anvil, the second spindle being disposed coaxially about the first spindle, the hammer being drivingly coupled to the second spindle; and a mode collar for selectively coupling the first and second spindles with the anvil and the transmission output member, wherein the mode collar is axially movable between a first position, in which the mode collar couples the first spindle to the transmission output member to drive the anvil, and a second position in which the mode collar couples the second spindle to the transmission output member to drive the anvil through the hammer, wherein the mode collar has a first set of teeth and a second set of teeth that are axially spaced apart from the first set of teeth, wherein the first set of teeth are engaged to teeth formed on the transmission output member and selectively engagable with the first spindle, and wherein the second set of teeth are selectively engagable with the second spindle;

wherein a friction clutch is disposed between the transmission output member and the first spindle, wherein the first spindle is biased away from the transmission output member but is axially movable into an override position in which the first spindle is coupled to the transmission output member through the clutch when the mode collar is in the second position.

* * * * *